US007490926B2

(12) United States Patent
Matsuba et al.

(10) Patent No.: US 7,490,926 B2
(45) Date of Patent: Feb. 17, 2009

(54) INK JET RECORDER AND INK FILLING METHOD

(75) Inventors: Hiroyuki Matsuba, Fukuoka (JP); Yoshinobu Ishimoto, Fukuoka (JP); Tetsuya Matsuzaki, Fukuoka (JP); Hideo Izawa, Chiba (JP); Takao Namiki, Chiba (JP)

(73) Assignees: Panasonic Corporation, Osaka (JP); Miyakoshi Printing Machinery Co., Ltd., Chiba (JP)

( * ) Notice: Subject to any disclaimer, the term of this patent is extended or adjusted under 35 U.S.C. 154(b) by 41 days.

(21) Appl. No.: 11/568,202

(22) PCT Filed: Apr. 26, 2005

(86) PCT No.: PCT/JP2005/008408

§ 371 (c)(1),
(2), (4) Date: Oct. 23, 2006

(87) PCT Pub. No.: WO2005/102708

PCT Pub. Date: Nov. 3, 2005

(65) Prior Publication Data

US 2007/0206071 A1 Sep. 6, 2007

(30) Foreign Application Priority Data

Apr. 27, 2004 (JP) ..... 2004-131889

(51) Int. Cl.
*B41J 2/17* (2006.01)

(52) U.S. Cl. ..... 347/84

(58) Field of Classification Search ..... 347/84, 347/85, 40, 43, 93
See application file for complete search history.

(56) References Cited

U.S. PATENT DOCUMENTS

| | | | |
|---|---|---|---|
| 4,559,543 | A | 12/1985 | Toganoh et al. |
| 4,952,947 | A | 8/1990 | Kyoshima |
| 6,312,094 | B1 | 11/2001 | Ito et al. |
| 6,315,390 | B1 | 11/2001 | Fujii et al. |
| 2003/0227520 | A1 | 12/2003 | Yamanaka et al. |
| 2004/0027426 | A1 | 2/2004 | Hewitt |
| 2004/0032451 | A1 | 2/2004 | Silverbrook et al. |
| 2005/0046665 | A1 | 3/2005 | Matsuba et al. |
| 2005/0046666 | A1 | 3/2005 | Horio et al. |

FOREIGN PATENT DOCUMENTS

| | | |
|---|---|---|
| EP | 0317267 | 5/1989 |
| EP | 1043159 | 10/2000 |
| EP | 1231062 | 8/2002 |
| JP | 7-47685 | 2/1995 |
| JP | 11-91130 | 4/1999 |

OTHER PUBLICATIONS

English Language Abstract of JP 11-91130.
English Language Abstract of JP 7-47685.

*Primary Examiner*—Lamson D Nguyen
(74) *Attorney, Agent, or Firm*—Wenderoth, Lind & Ponack, L.L.P.

(57) ABSTRACT

An ink jet recorder that includes line heads (4) having a plurality of nozzle heads (41), main tanks (13) placed outside of the line heads (4) to store ink; an ink supply passage (13*a*, 49*a*, 49*c*) that connects the main tanks (13) to the associated nozzle heads (41), and distribution tanks (6) placed in each line head (4). The number of supply tube connections (67) provided in the distribution tank (6) is smaller than that of the nozzle heads (41) arranged in the line head (4).

7 Claims, 12 Drawing Sheets

INK JET RECORDER AND INK FILLING METHOD

BACKGROUND OF THE INVENTION

1. Technical Field

This invention relates to an ink jet recorder and an ink filling method for the recorder.

2. Description of the Related Art

Ink jet recorders are known that record an image on a recording medium by ejecting ink thereon from nozzle heads formed with nozzles. As an example of ink jet recorders of this kind, a recorder with main tanks disposed separately from nozzle heads (not integrally with them) is disclosed in Japanese Unexamined Patent Application Publication No. H07-47685. This recorder comprises a plurality of nozzle heads for ejecting different colored inks and a plurality of main tanks for storing different colored inks in correspondence with the nozzle heads. The inks in the main tanks can be supplied to the nozzle heads, respectively, by one-to-one connection between the plurality of nozzle heads and the plurality of main tanks via a plurality of supply tubes.

The ink jet recorder disclosed in the above publication is a so-called serial type recorder that ejects ink while reciprocally scanning nozzle heads in a main scanning direction (widthwise of a recording medium). Unlike this, another ink jet recorder is also known that includes a line head with nozzles arranged over the full width of a recording medium and records an image without moving the head.

The line head is a long member extending the full width of the recording medium and therefore it is difficult to make it in one piece. In view of this, a technique is also known to configure a long line head by aligning nozzle heads of relatively small area along the width of the recording medium.

For such a line head configured by aligning a plurality of nozzle heads, however, ink must be supplied from the main tanks to the nozzle heads, respectively. This presents an inconvenience in that the organization of an ink supply system is complicated.

For example, when a design is employed in which the nozzle heads are connected individually via a large number of tubes to the main tanks, provision of such a large number of tubes increases the parts account, leading to cost rise. Furthermore, since the layout space for the tubes between the main tanks and the line head is increased, the recorder size is also increased. Furthermore, in removing the line head from the recorder for maintenance or other purposes, the large number of tubes connected to the line head must be detached therefrom. In reassembling them, the large number of tubes must be in turn connected to the line head. Therefore, this design reduces maintainability.

SUMMARY OF THE INVENTION

The present invention has been made in view of the foregoing points and its object is to simplify the organization of an ink supply system in an ink jet recorder equipped with a line head having a plurality of nozzle heads.

An ink jet recorder of the present invention comprises: a line head including a plurality of nozzle heads arranged over the full width of a recording medium and in alignment along the width of the recording medium; a main tank that is placed outside of the line head and stores ink; an ink supply passage that connects the main tank to each of the nozzle heads to supply the ink in the main tank to each of the nozzle heads; and at least one distribution tank that is provided in the line head and partway along the ink supply passage.

Further, the distribution tank includes an upstream connection connected to part of the ink supply passage toward the main tank and a downstream connection connected to part of the ink supply passage toward the nozzle heads, and the total number of said upstream connections for the line head is smaller than the number of the nozzle heads arranged in the line head. Here, the distribution tank means a tank that supplies ink to two or more nozzle heads.

With the above structure, the line head and the main tank is connected to each other by a member forming part of the ink supply passage (for example, a tube), so that ink in the main tank is supplied to each nozzle head of the line head through the ink supply passage. The distribution tank in the line head is placed partway along the ink supply passage, and the number of upstream connections provided in the distribution tank is smaller than that of the nozzle heads arranged in the line head. Therefore, the number of tubes disposed between the line head and the main tank is naturally smaller than that of the nozzle heads. This provides reduced cost due to the reduced number of parts forming the ink supply passage, size reduction of the recorder due to saving in layout space for the ink supply passage, and enhanced maintainability due to ease of attachment/detachment of the line head.

The total number of said downstream connections may be equal to or smaller than the number of the nozzle heads. Note that since the distribution tank is a tank that supplies ink to two or more nozzle heads, the number of the downstream connections is two or more.

An ink filling method of the present invention is an ink filling method for filling with ink each of a plurality of nozzle heads of an ink jet recorder comprising: a head unit including the plurality of nozzle heads; a main tank for storing ink; a distribution tank placed partway along an ink supply passage located between the main tank and each of the nozzle heads.

The above ink filling method comprises: a first step of opening an air discharge passage connected to the distribution tank to the atmosphere and enhancing the backing pressure of the main tank, thereby supplying ink from the main tank through the ink supply passage to the distribution tank; a second step of making the air discharge passage closed to the atmosphere after the distribution tank is filled with ink; and a third step of sucking air from nozzle openings of each of the nozzle heads, thereby supplying ink from the distribution tank into each of the nozzle heads.

With this configuration, in the first step, the ink jet recorder, in which the distribution tank is placed partway along the ink supply passage connected between the head unit and the main tank, opens the air discharge passage connected to the distribution tank to the atmosphere and enhances the backing pressure of the main tank. Thus, air in the distribution tank is discharged through the air discharge passage and concurrently ink is supplied from the main tank through the ink supply passage to the distribution tank.

In the subsequent second step, the air discharge passage is closed to the atmosphere after the distribution tank is filled with ink.

Then, in the third step, air is sucked from the nozzle openings of each nozzle head. Thus, ink is supplied from the distribution tank filled with ink into each nozzle head, thereby reliably filling each nozzle head with ink.

Other objects of the present invention will be apparent to those skilled in the art to which the invention belongs from the following detailed description with reference to the accompanying drawings.

DETAILED DESCRIPTION OF THE INVENTION

An embodiment of the present invention will be below described in detail with reference to the drawings.

General Structure of Recorder

An ink jet recorder A according to this embodiment uses a piezoelectric effect of a piezoelectric actuator to eject ink droplets from an ink jet head and land them onto a recording medium, thereby recording an image on the recording medium.

Figure 1:
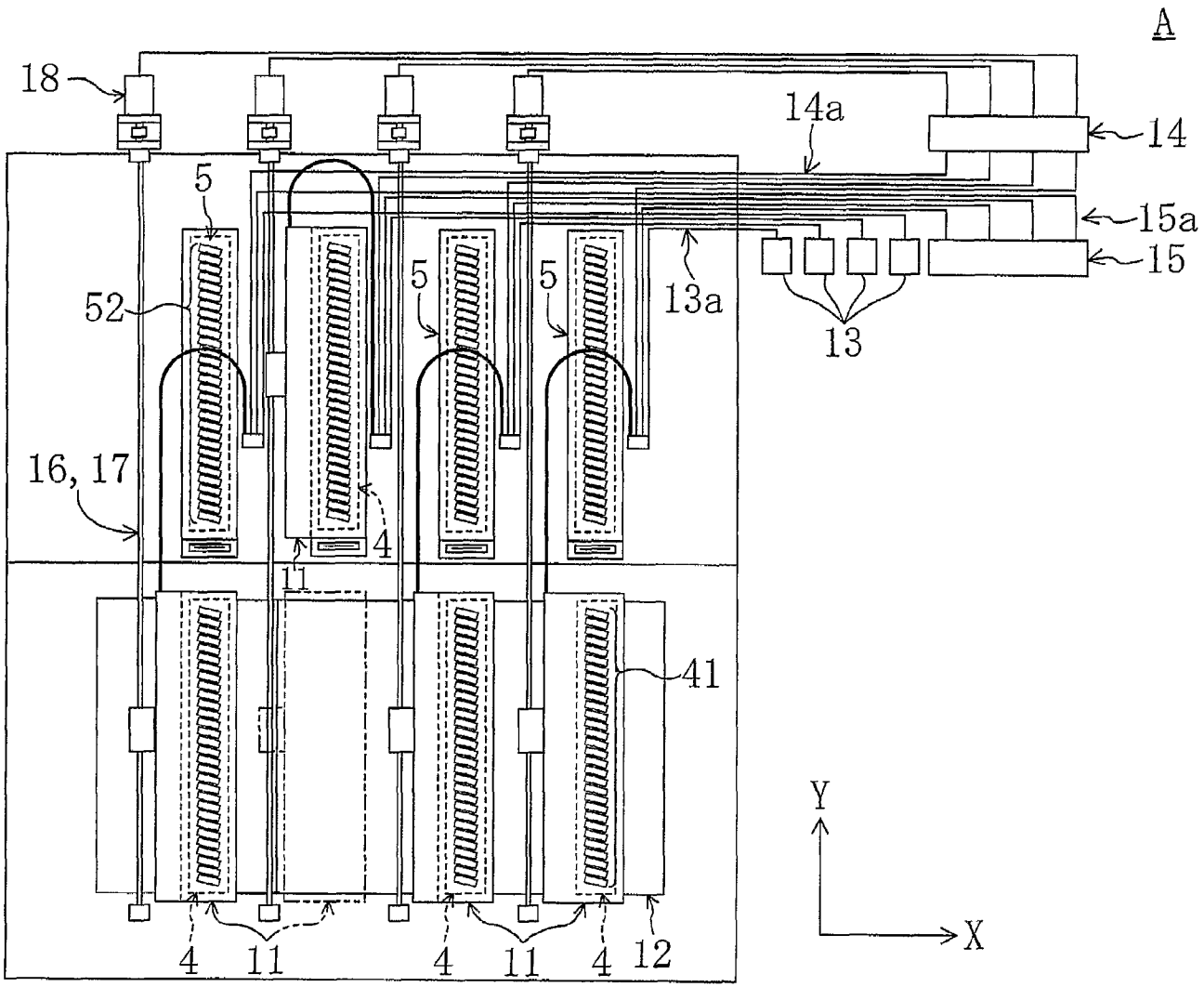
FIG. 1 is a plan view of a recorder.
Figure 2:
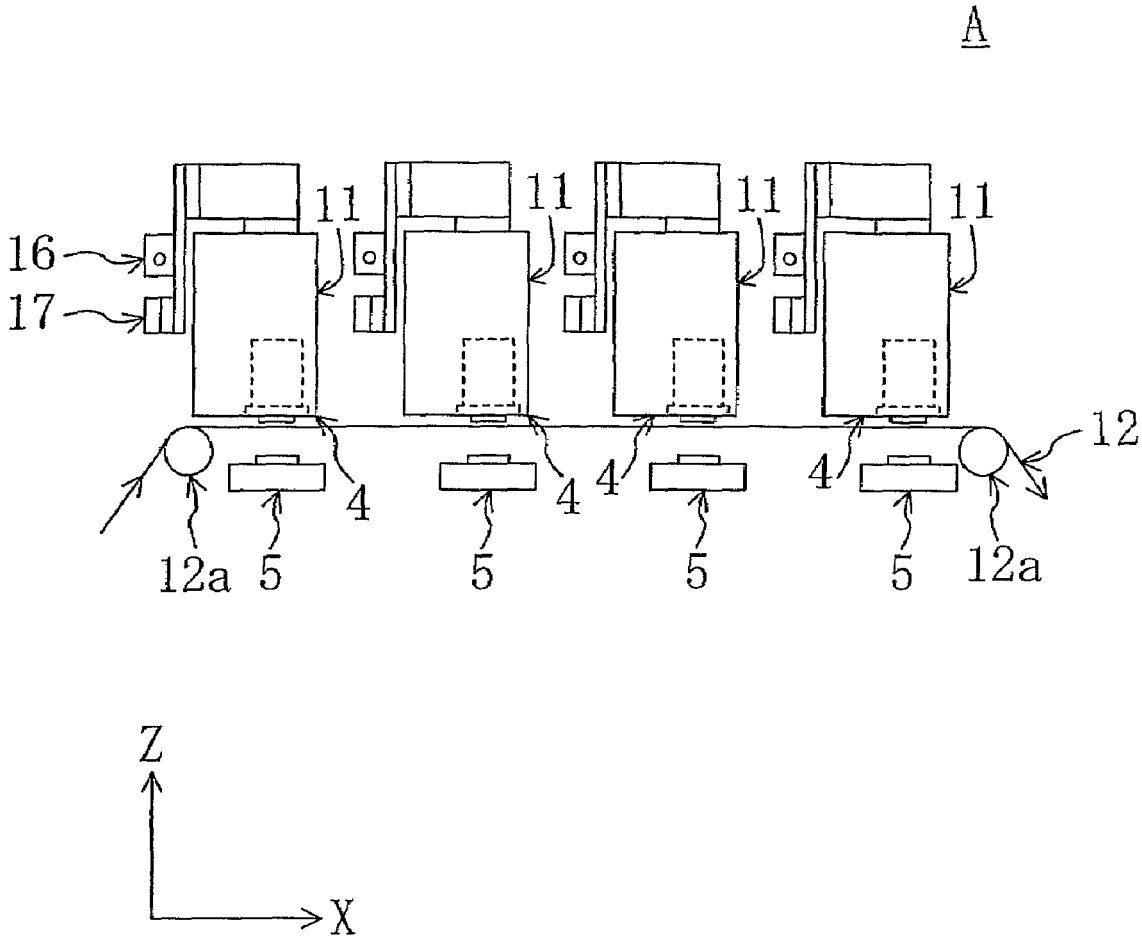
FIG. 2 is a front view of the recorder.

As shown in FIGS. 1 and 2, the recorder A has four ink jet heads 11. The four ink jet heads 11 are an ink jet head 11 for ejecting black ink, an ink jet head 11 for ejecting yellow ink, an ink jet head 11 for ejecting magenta ink, and an ink jet head 11 for ejecting cyan ink. The recorder A can make color prints using four colors of ink.

The recording medium 12 is put below the ink jet heads 11 and transported in a predetermined transport direction (in the X direction) by a plurality of rollers 12*a*. Alternatively, the recording medium 12 may take the form of paper roll (not shown) and may be fed from the roll.

Each ink jet head 11 is disposed so as to extend widthwise of the recording medium 12 (in the Y direction), and the four ink jet heads 11 are aligned in the X direction at regular intervals.

Figure 4:
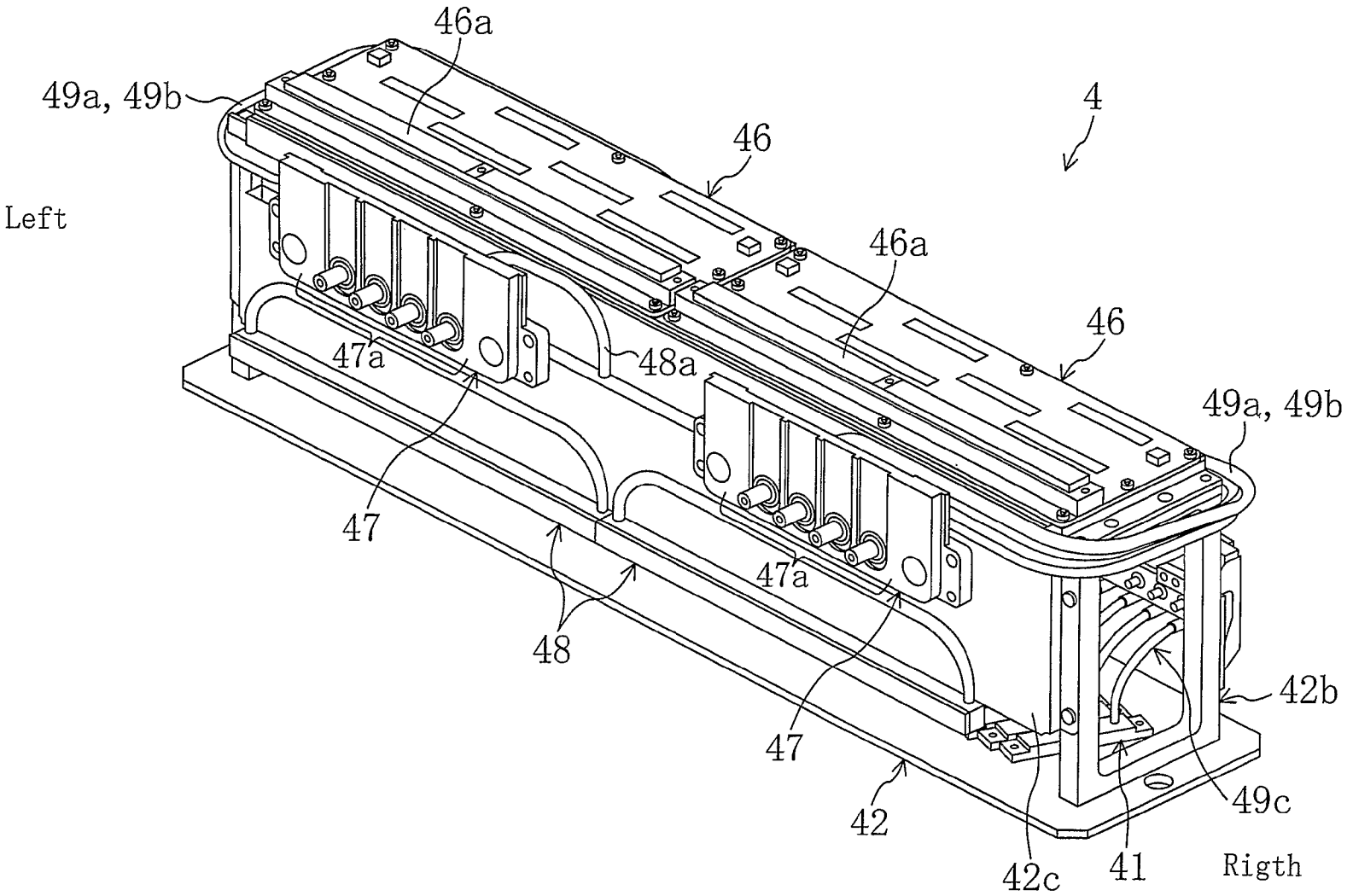
FIG. 4 is a perspective view of a line head.
Figure 5:
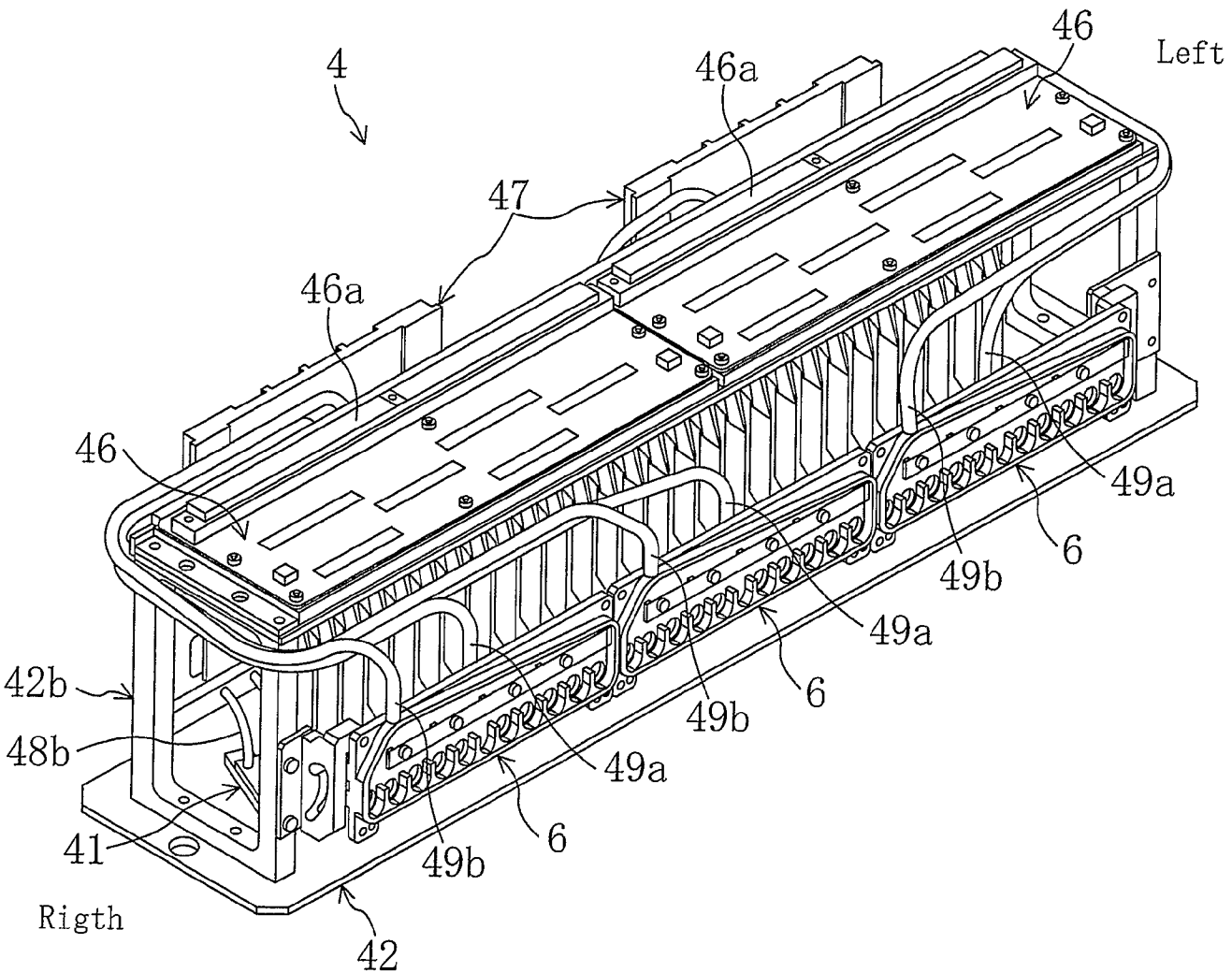
FIG. 5 is another perspective view of the line head.
Figure 6:
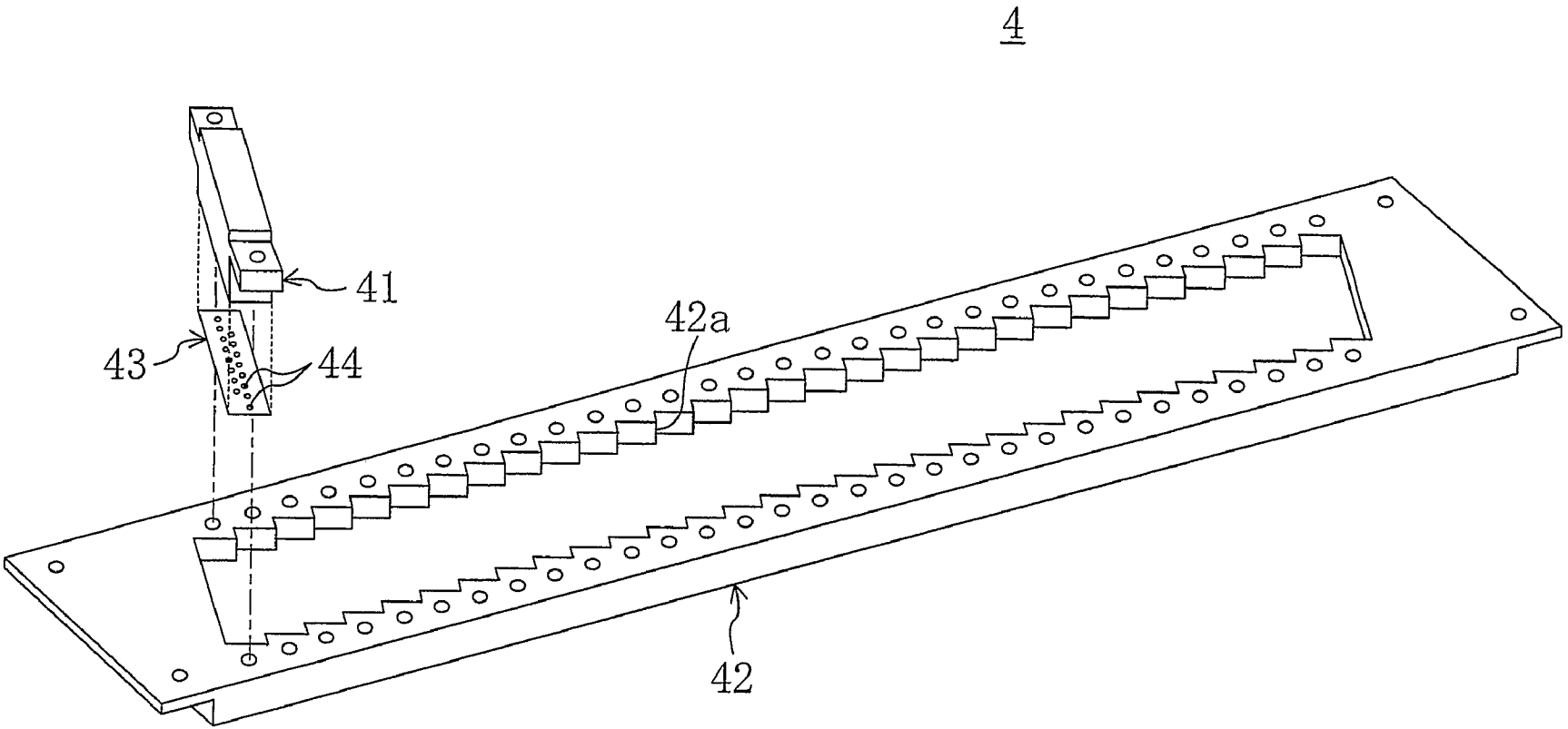
FIG. 6 is an exploded perspective view of the line head.

Each ink jet head 11, as shown in FIGS. 1 to 6, includes a line head 4 extending in the Y direction. The line head 4 includes a plurality of nozzles 44 for ejecting ink and a plurality of piezoelectric actuators (not given in FIGS. 1 to 6) for bringing the corresponding nozzles 44 into ink ejection. The nozzles 44 are arranged over the full width of the recording medium 12. Note that, for ease of understanding, the line head 4 in FIG. 6 is shown reduced in the number of nozzles 44 from the actual line head 4.

As above, each ink jet head 11 has a plurality of nozzles 44 arranged over the full width of the recording medium 12. Therefore, in a recording operation, the recorder A ejects ink through designated nozzles 44 at designated timings while transporting the recording medium 12 in the transport direction. Therefore, even if each ink jet head 11 is not moved widthwise of the recording medium 12, a desired image can be created over the full width (e.g., the width of A2 in JIS) of the recording medium 12.

Each ink jet head 11, as shown in FIGS. 1 and 2, is supported by a ball screw 16 and a linear guide 17 both disposed so as to extend in the Y direction. The ball screw 16 is driven rotatably by a motor 18 attached to one end thereof. Through the rotation of the ball screw 16 driven by the motor 18, the ink jet head 11 reciprocally moves in the Y direction while being guided by the ball screw 16 and the linear guide 17. In this manner, each ink jet head 11 can be shifted between a recording position, which is a transported position to which the recording medium 12 is transported, and a cleaning position where the later-described purge unit 5 is placed. Note that since the four ball screws 16 are individually rotatably driven by separate motors 18, the four ink jet heads 11 can be moved independently of each other between the recording position and the cleaning position.

The recorder A includes four purge units 5 for cleaning the corresponding line heads 4 of the ink jet heads 11. These purge units 5 are placed outside in the Y direction from the transported position of the recording medium 12, that is, in the cleaning position. The four purge units 5 are placed below the level of the ink jet heads 11 and aligned in the X direction at regular intervals in correspondence with the ink jet heads 11.

Each purge unit 5 includes a plurality of caps 52 and a suction pump (not shown). The caps 52 are aligned in the Y direction in correspondence with nozzle heads 41 contained in the ink jet head 11.

Figure 13:
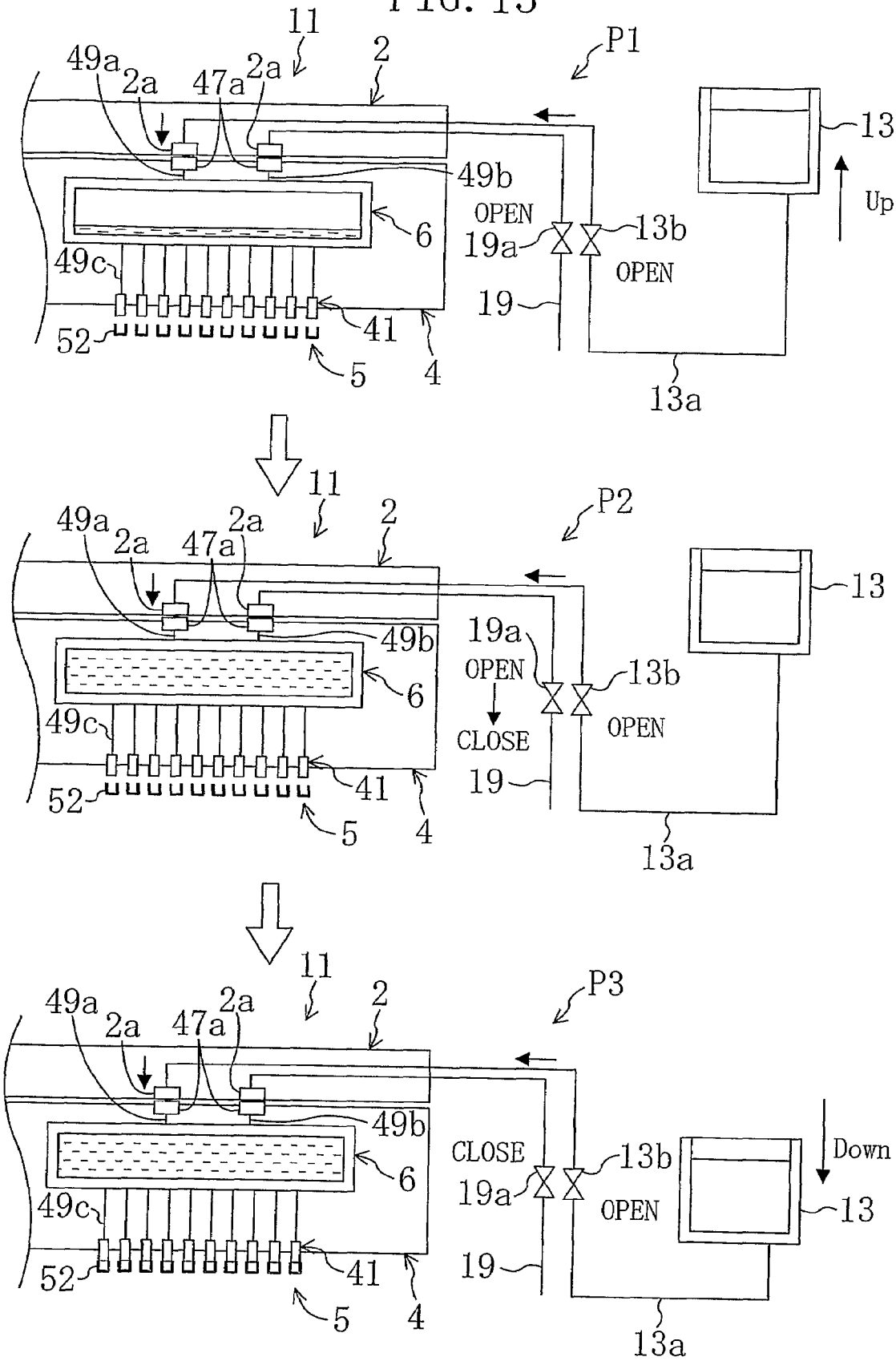
FIG. 13 is an illustration showing a procedure for filling a nozzle head with ink.

Each cap 52 is formed substantially in the shape of an open-top box as shown in FIG. 13 and connected to the suction pump described above. Each purge unit 5 is designed to move up and down by a linear actuator (not shown). Thus, the purge unit 5 can be changed to and from between a cleaning condition where each cap 52 comes into close contact with the bottom of the associated nozzle head 41 of the ink jet head 11 positioned at the cleaning position and a wait condition where the cap 52 is kept away from the bottom of the associated nozzle head 41.

Since the caps 52 are provided in correspondence with the individual nozzle heads 41 as described above, the size of each cap 52 can be reduced, which facilitates close contact of each cap 52 with the bottom of the nozzle head 41 (i.e., makes it difficult to cause pressure leakage during pressure reduction of the inside of the cap 52). In addition, this enables selective operation between a general cleaning for carrying out a simultaneous suction of all of nozzle heads 41 contained in one ink jet head 11 and a specific cleaning for carrying out an individual suction of a specific nozzle head 41. The general cleaning may be carried out in filling the nozzle heads 41 with ink as described later or in other necessary cases, while the specific cleaning may be carried out when the nozzle head 41 with its blocked nozzles has been identified, for example, through a test print. If the specific cleaning can be carried out, the amount of ink consumption can be reduced.

The recorder A has four main tanks 13. The four main tanks 13 are a main tank 13 for storing black ink, a main tank 13 for storing yellow ink, a main tank 13 for storing magenta ink, and a main tank 13 for storing cyan ink. The four ink jet heads 11 are connected in one-to-one correspondence through ink supply main tubes 13*a* to the four main tanks 13. Ink in each main tank 13 is supplied through the associated ink supply main tube 13*a* to the associated ink jet head 11. Each ink supply main tube 13*a*, which connects the associated ink jet head 11 to the associated main tank 13, may be formed of a single tube or a bundle of tubes. Although not shown in FIG. 1, a shut-off valve 13*b* is placed partway along the ink supply main tube 13*a* (see FIG. 13).

The recorder A also includes a power supply and control box 14. Each ink jet head 11 is connected through a transmission line 14*a* to the power supply and control box 14. The power supply and control box 14 supplies power and control signals to each of the ink jet heads 11 and also supplies control signals to each of the motors 18 attached to ends of the ball screws 16.

The recorder A also includes an air supply source 15. Each ink jet head 11 is connected through an air supply main tube 15*a* to the air supply source 15. The air supply source 15 supplies dry air to each ink jet head 11. Through the supply of dry air, moisture causing a failure of the piezoelectric actuator (piezoelectric element) is removed thereby extending the lifetime of the piezoelectric element.

Although not shown in FIG. 1, each ink jet head 11 is connected to an air discharge main tube 19 (see FIG. 13). The air discharge main tube 19 is a tube for discharging air in a distribution tank 6 as described later, and is connected to a suction pump (not shown). Further, a shut-off valve 19*a* is placed partway along the air discharge main tube 19.

Structure of Ink Jet Head

Figure 3:
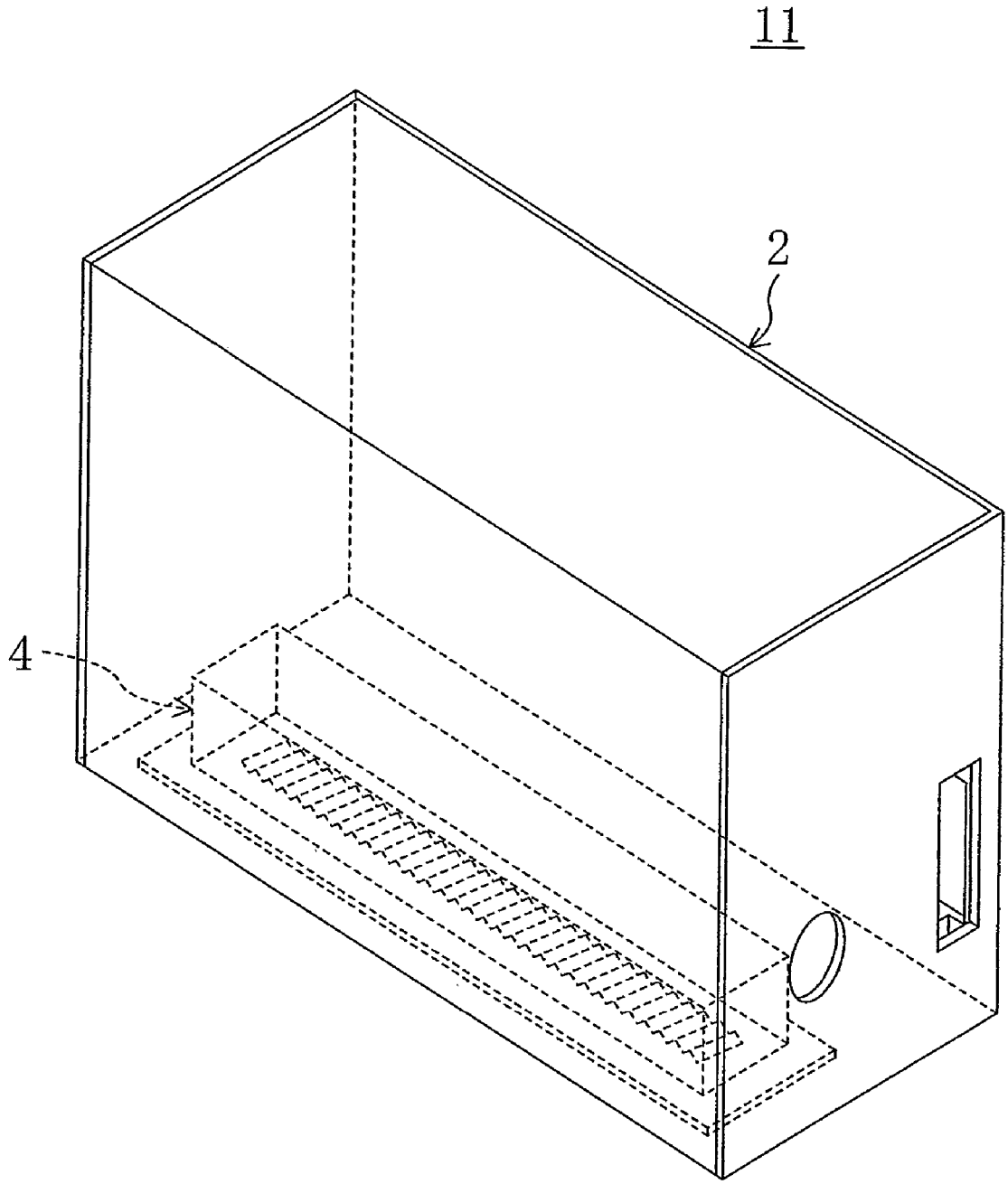
FIG. 3 is a perspective view of an ink jet head.

Each ink jet head 11 has a structure in which a line head 4 is contained in a main box 2 as shown in FIG. 3.

The main box 2 has a rectangular parallelepiped shape and is equipped internally with a circuit board, tubes for ink supply and tubes for other purposes.

The line head 4 includes, as shown in FIGS. 4 to 6, a plurality of nozzle heads 41 and a base plate 42 that holds the nozzle heads 41. Hereinafter, the near right side in FIG. 4 (the near left side in FIGS. 5 and 6) and the far left side in FIG. 4 (the far right side in FIGS. 5 and 6) are referred to as right side and left side of the line head 4, respectively.

The base plate 42 is made of an elongated plate material and is formed at its center with an opening 42*a* extending in the longitudinal direction of the plate. The edges of the opening 42*a* are shaped in a waveform. Each nozzle head 41 is fixed to the base plate 42 at a tilt (angle) with the longitudinal direction of the base plate 42 to fit into the waveform. Although in FIG. 6 only one nozzle head 41 is given, a plurality (30 in an example of FIG. 6) of nozzle heads 41 are actually aligned in the longitudinal direction of the base plate 42.

Each nozzle head 41 includes a nozzle plate 43 having a plurality of nozzles 44 substantially in a staggered arrangement. Since the plurality of nozzle heads 41 are aligned in the longitudinal direction of the base plate 42, the nozzles 44 are arranged over the full width of the recording medium 12 and substantially at regular intervals widthwise of the recording medium 12.

Figure 7:
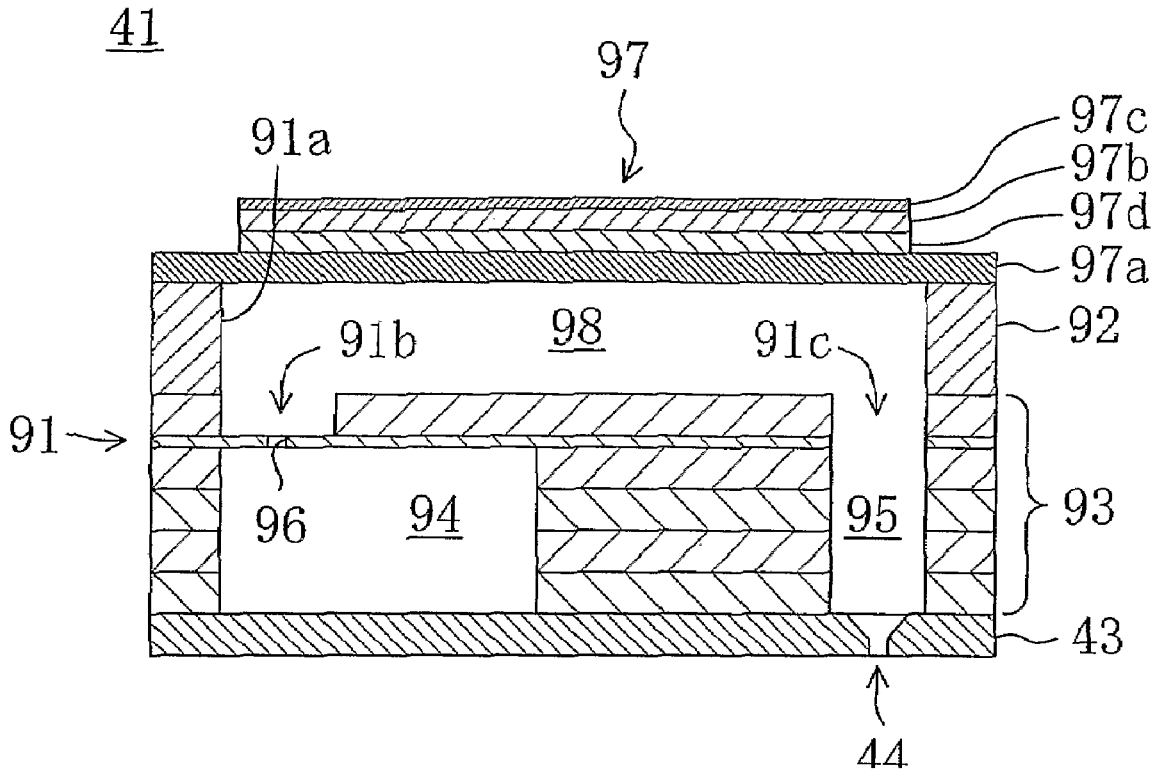
FIG. 7 is a longitudinal cross-sectional view of a nozzle head.

The nozzle head 41 ejects ink by a piezoelectric effect of the piezoelectric actuator. As shown in FIG. 7, the nozzle head 41 includes a head body 91 formed with a plurality of recesses 91*a* for pressure chambers. The recesses 91*a* are formed in correspondence with the nozzles 44 formed in the nozzle plate 43, and aligned along the rows of nozzles 44. Each recess 91*a* is formed together with a supply port 91*b* for supplying ink into the recess 91*a* and a discharge port 91*c* for discharging ink from the recess 91*a*.

The sidewalls of each recess 91*a* are formed of a pressure chamber component 92. An ink channel component 93 is adhered to the bottom of the pressure chamber component 92. The bottom wall of each recess 91*a* is formed of the above ink channel component 92.

The ink channel component 93 is formed by stacking a plurality of thin plates. The ink channel component 93 is formed with a single ink supply channel 94, a plurality of ink ejection channels 95, and a plurality of orifices 96. Each orifice 96 is connected to the supply port 91*b* of the associated recess 91*a*. The ink supply channel 94 is formed to extend in the direction of alignment of the recesses 91*a* (along the rows of nozzles 44) and connected to each orifice 96. The ink supply channel 94 is also connected to a later-described ink distribution tube 49*c*. Each ink ejection channel 95 is connected to the discharge port 91*c* of the associated recess 91*a*.

The nozzle plate 43 is adhered to the bottom of the ink channel component 93. Each nozzle 44 formed in the nozzle plate 43 is connected to the associated ink ejection channel 95.

The piezoelectric actuator 97 is placed on the top side of the associated recess 91*a* of the head body 91. Each piezoelectric actuator 97 has a diaphragm 97*a* made of Cr. The diaphragm 97*a* closes each recess 91*a* of the head body 91 in a manner adhered to the top of the head body 91 to constitute a pressure chamber 98 together with the recess 91*a*. The diaphragm 97*a* is a single piece common to all the piezoelectric actuators 97 and also serves as a common electrode for all of later-described piezoelectric elements 97*b*.

Each piezoelectric actuator 97 also has a piezoelectric element 97*b* made of lead zirconate titanate (PZT) and a separate electrode 97*c* made of Pt. The piezoelectric element 97*b* is disposed to the surface of the diaphragm 97*a* opposite to the pressure chamber 98 (the top of the diaphragm 97*a*) and in a portion thereof corresponding to the pressure chamber 98 (a portion thereof facing to the opening of the recess 91*a*) with an intermediate layer 97*d* of Cu interposed between the piezoelectric element 97*b* and the diaphragm 97*a*. Separate electrodes 97*c* are joined to the surfaces of the associated piezoelectric elements 97*b* opposite to the diaphragm 97*a* (the tops thereof), respectively. Each separate electrode 97*c* is an electrode for applying voltage (drive voltage) to the associated piezoelectric element 97*b* in cooperation with the diaphragm 97*a*. Note that the diaphragm 97*a*, the piezoelectric elements 97*b*, the separate electrodes 97*c* and the intermediate layers 97*d* are all formed of thin films.

In each piezoelectric actuator 97, drive voltage is applied to the piezoelectric element 97*b* through the diaphragm 97*a* and the separate electrode 97*c* to deform the portion of the diaphragm 97*a* corresponding to the pressure chamber 98 (the portion thereof corresponding to the opening of the recess 91*a*). Thus, ink in the pressure chamber 98 is ejected through the discharge port 91*c* out of the nozzle 44.

The line head 4 includes two relay boards 46, two coupler units 47, two air manifolds 48 and three (in other words, 3-for-1 split) distribution tanks 6.

The two relay boards 46 are arranged side by side in their longitudinal direction to span the top ends of two side frames 42*b* standing at both longitudinal ends of the base plate 42 and supported by these side frames 42*b*. The two relay boards 46 include connectors 46*a* coupled to connectors of the main box 2, respectively. As shown in FIGS. 4 and 5, the connectors 46*a* are placed on the top of the line head 4 to face upward. Although the following is not shown, out of the nozzle heads 41 under the relay boards 46, 15 nozzle heads 41 located on the right hand in the longitudinal direction are connected to the right-hand relay board 46 through an FPC, while 15 nozzle heads 41 located on the left hand in the longitudinal direction are connected to the left-hand relay board 46 through an FPC. In this manner, wires from nozzle heads 41 are connected to the relay boards 46, so that electrical connection between the line head 4 and the main box 2 is implemented by only the connectors 46*a* of the relay boards 46.

The two coupler units 47 are arranged at the upper part of the rear face of the line head 4 side by side in the longitudinal direction, and fixed to a support plate 42*c* attached to the side frames 42*b*. Each coupler unit 47 has four couplers 47*a* connected to couplers 2*a* of the main box 2, respectively. Each coupler 47*a* is disposed to face laterally from the rear face of the line head 4. One (left-hand one) of the two coupler units 47 is connected with three tubes, i.e., a head air supply tube 48*a*, a head ink supply tube 49*a* and head air discharge tube 49*b* all later-described. The other (right-hand) coupler unit 47 is connected with four tubes, i.e., two head ink supply tubes 49*a* and two head air discharge tubes 49*b*. Thus, three of the eight couplers 47*a* are for ink supply, three for air discharge, one for air supply, and one not used.

The two air manifolds 48 are placed at the lower part of the rear face of the line head 4 so as to extend in the longitudinal direction and fixed to the support plate 42*c*. The head air supply tube 48*a* connected to the coupler unit 47 is branched twice and then connected to both ends of each of the two air manifolds 48. Out of the nozzle heads 41, 15 nozzle heads 41 located on the right hand in the longitudinal direction are connected through air distribution tubes 48*b*, respectively, to the air manifold 48 located to the right while the remaining nozzle heads 41 are connected through air distribution tubes 48*b*, respectively, to the air manifold 48 located to the left (see FIG. 5). Thus, dry air is supplied from the air supply source 15 through the air supply main tubes 15*a*, the coupler units 47, the head air supply tube 48*a*, the air manifolds 48 and the air distribution tubes 48*b* to the individual piezoelectric elements built in the nozzle heads 41 and their surroundings. As a result, the piezoelectric elements and their surroundings are dried as described above.

The three distribution tanks 6, as shown in FIG. 5, are arranged at the front face of the line head 4 side by side in the longitudinal direction and supported by the side frames 42*b*. Each of the three distribution tanks 6 is connected with the head ink supply tube 49*a* and the head air discharge tube 49*b* both connected to either of the coupler units 47. Each head ink supply tube 49*a* is a tube for supplying ink to the associated distribution tank 6, while each head air discharge tube 49*b* is a tube for discharging air from the associated distribution tank 6 in filling the nozzle heads 41 with ink or for the removal of air stored in the distribution tank due to deposition in the nozzle heads 41. The three head ink supply tubes 49*a* and three head air discharge tubes 49*b* are disposed to pass the outsides of both ends of the line head 4 and extend from the rear face to the front face thereof.

Figure 8:
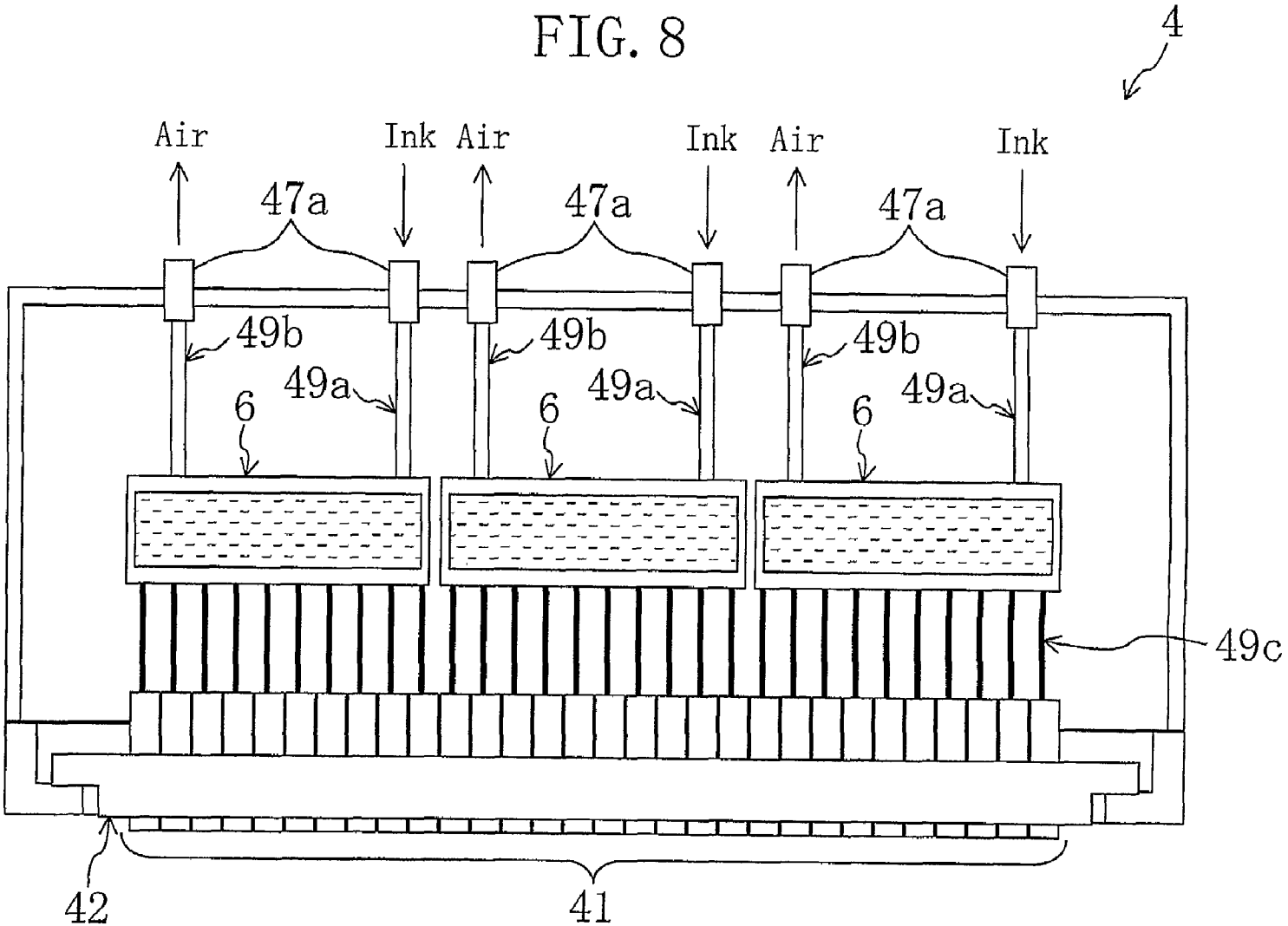
FIG. 8 is a schematic diagram showing the structure of the line head.
Figure 12:
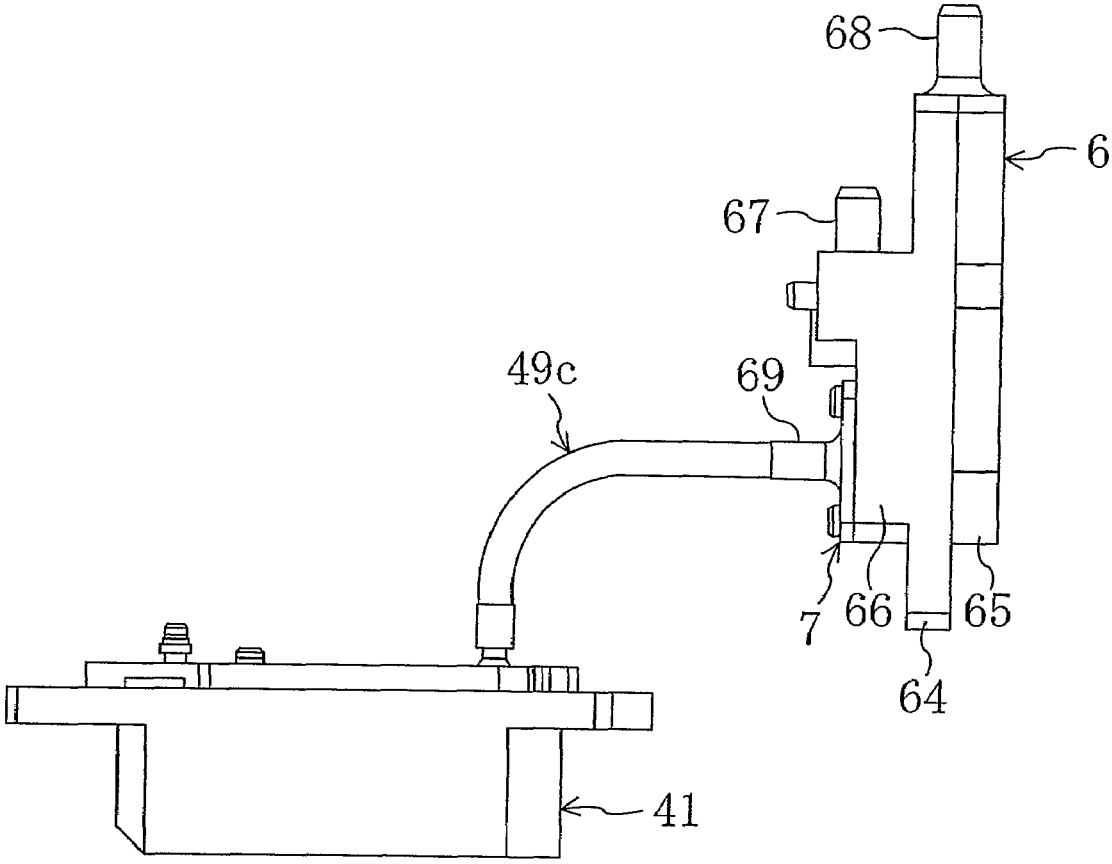
FIG. 12 is an illustration showing how the distribution tank is connected to the nozzle head.

As shown in FIG. 8 (which is a diagram schematically showing the structure of the line head 4), out of the nozzle heads 41 contained in the line head 4, 10 nozzle heads 41 disposed to the right in the longitudinal direction are connected through the ink distribution tubes 49*c*, respectively, to one of the three distribution tanks 6 placed to the right, 10 nozzle heads 41 disposed intermediately in the longitudinal direction are connected through the ink distribution tubes 49*c*, respectively, to one of the three distribution tanks 6 placed intermediately, and 10 nozzle heads 41 disposed to the left in the longitudinal direction are connected through the ink distribution tubes 49*c*, respectively, to one of the three distribution tanks 6 placed to the left (see FIG. 12). The details of the placement of the ink distribution tube 49*c* will be described later.

In the above manner, ink will be supplied from the main tank 13 through the ink supply main tube 13*a*, the coupler units 47, the head ink supply tubes 49*a*, the distribution tanks 6 and the ink distribution tubes 49*c* to the individual nozzle heads 41.

Structure of Distribution Tank

Figure 9:
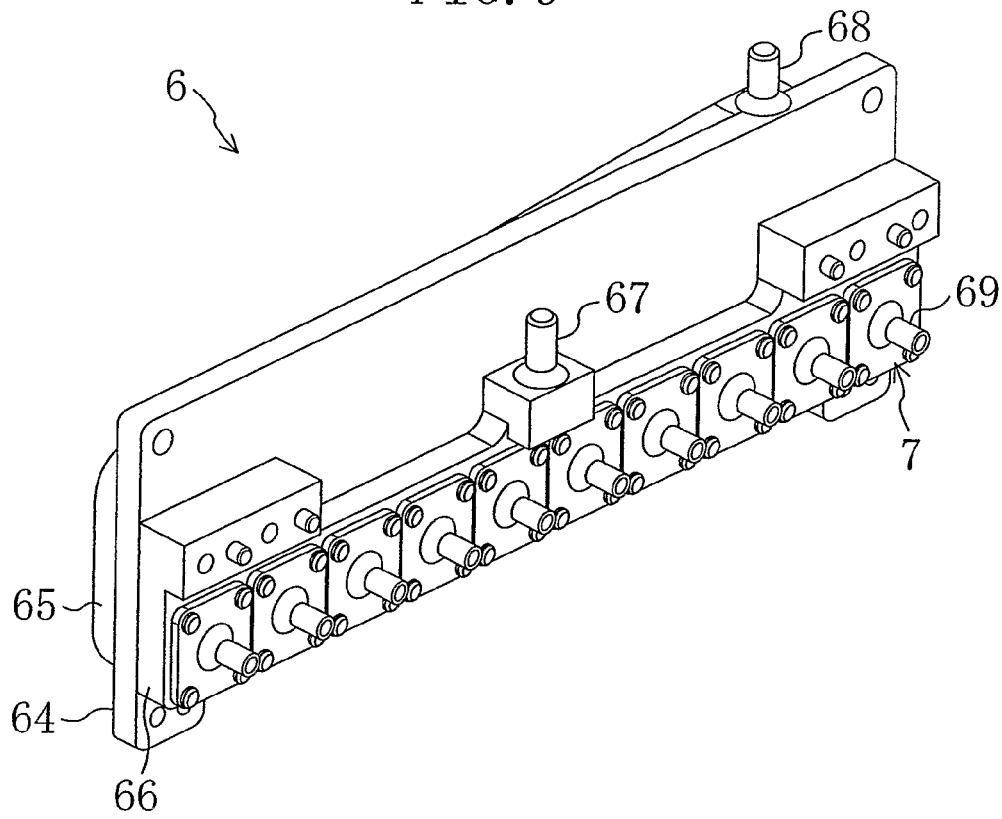
FIG. 9 is a perspective view of a distribution tank.
Figure 10:
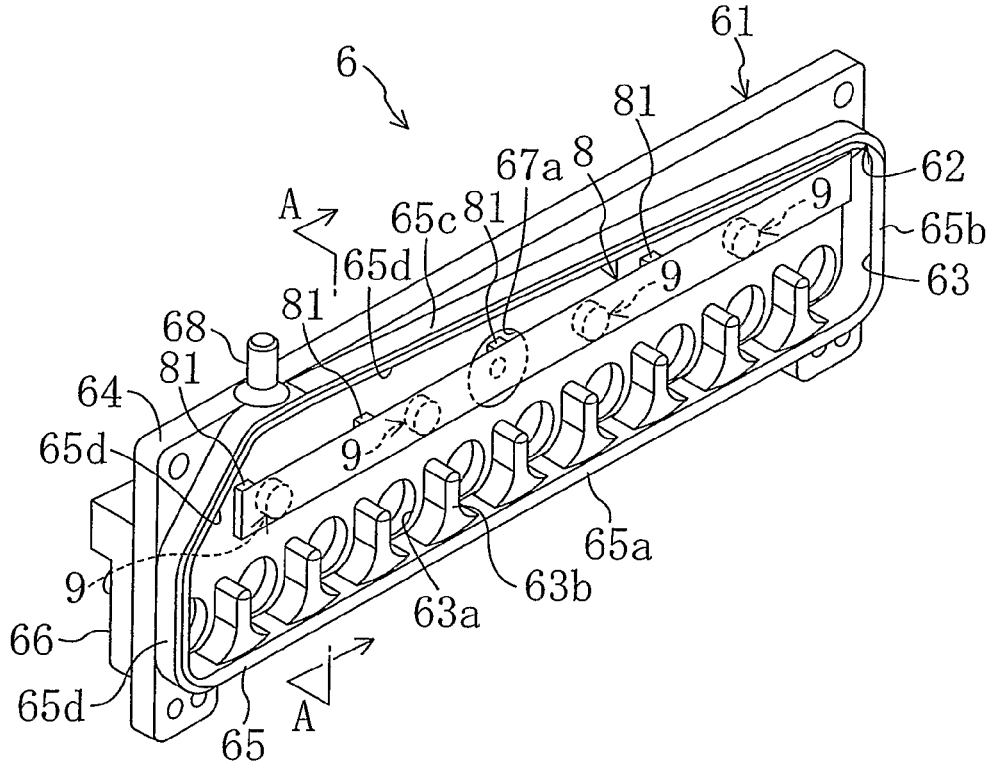
FIG. 10 is another perspective view of the distribution tank.
Figure 11:
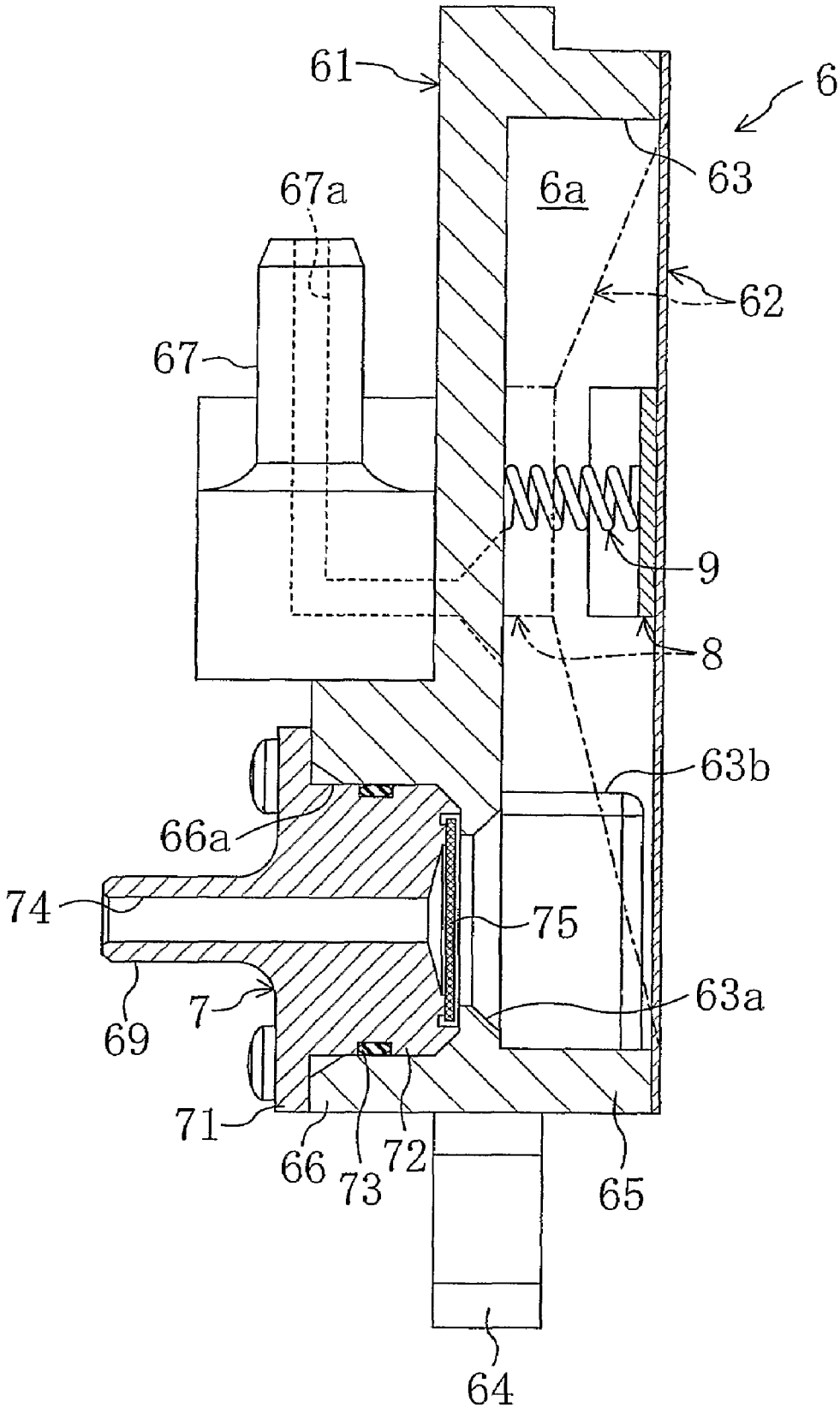
FIG. 11 is a cross-sectional view showing the section A-A of FIG. 10.

As shown in FIGS. 9 to 11, each distribution tank 6 consists of a tank body 61 of a planar shape having a recess 63 formed at one side, and a film 62 closing the opening of the recess 63 of the tank body 61. In this embodiment, the film 62 is made of a transparent material and therefore the above figures show a tank internal space visible from the outside.

The tank body 61 has a substantially long-plate-shaped flange 64 fixed to the line head 4 (its side frame 42*b*). On one side of the flange 64, a defining wall 65 is formed which extends in the form of a frame to define the recess 63. The defining wall 65 is formed of a bottom wall 65*a*, two sidewalls 65*b* and a top wall 65*c*. The top wall 65*c* has guide faces 65*d* located on its side facing the inside of the recess 63 and on both sides of an air discharge tube connection 68 placed at one end of the top wall 65*c* in the longitudinal direction to incline upward toward the connection 68.

The other side of the flange 64 is provided at the lower part with a joint mounting part 66 protruding from that side thereof and extending in the longitudinal direction. The joint mounting part 66 is formed with ten mounting holes 66*a* (see FIG. 11) opening at the protruding end face of the joint mounting part 66 to ensure alignment in the longitudinal direction. Further, as shown in FIGS. 10 and 11, the lower part of the flange 64 is formed with ten through holes 63*a* passing through the flange 64 along the thickness thereof to align the tank body in the longitudinal direction. Each through hole 63*a* communicates with the associated mounting hole 66*a*. Furthermore, in the recess 63, ribs 63*b* are provided between the openings of adjacent through holes 63*a*.

On said other side of the flange 64, a supply tube connection 67, to which the head ink supply tube 49*a* is connected, is placed above the joint mounting part 66 and in the middle of the length of the flange 64 to face upward. An ink channel 67*a* is formed in the supply tube connection 67 and is open at said one side of the flange 64 substantially in the lengthwise and heightwise middle of the recess 63. This opening has a tapered shape that gradually expands towards the opening end. If, thus, the opening of the ink channel 67*a* is located substantially in the lengthwise and heightwise middle of the recess 63, this does not result in less variation among the distances from the opening to the individual through holes 63*a*.

On the top of the tank body 61, an air discharge tube connection 68, to which the head air discharge tube 49*b* is connected, is placed to face upward. The air discharge tube connection 68 is placed at one end of the tank body 61 in the longitudinal direction, and is offset lengthwise and heightwise from the supply tube connection 67. If, thus, the supply tube connection 67 is shifted in position from the air discharge tube connection 68, this avoids interference between the head ink supply tube 49*a* and the head air discharge tube 49*b*. Further, an air passage communicating with the recess 63 is formed in the inside of the air discharge tube connection 68, though it is not shown.

Furthermore, as shown in FIGS. 11 and 12, joints 7 are mounted to the joint mounting part 66 of the tank body 61, so that distribution tube connections 69 are formed to which the ink distribution tubes 49*c* are respectively connected. Each joint 7 consists of a distribution tube connection 69 of relatively small diameter, a flange 71 of rectangular section at the root end of the distribution tube connection 69, and an expanded part 72 of relatively large diameter on the opposite side of the joint 7 to the distribution tube connection 69 with the flange 71 interposed therebetween.

The expanded part 72 is a part which is inserted into the associated mounting hole 66*a* of the joint mounting part 66 and provided at its outer periphery with a groove 73 into which an O-ring is fitted. A through hole 74 is formed inside of the joint 7 and expands in diameter at the root end of the expanded part 72. A filter 75 is placed at the root end of the expanded part 72. When the joint 7 is mounted and fixed to the joint mounting part 66, the through hole 63*a* of the flange 64 and the through hole 74 of the joint 7 constitute an ink passage with the filter 75 interposed therebetween.

The joint 7 is mounted to the tank body 61 by fastening the flange 71 to the joint mounting part 66 by screws. Thus, the joint 7 becomes detachable from the tank body 61. When the joint 7 is mounted and fixed, a connection hole for the ink distribution tube 49*c* is placed at the lower part of the distribution tank 6 to face laterally. As shown in FIG. 12, the ink distribution tube 49*c* is disposed between the distribution tank 6 and the associated nozzle head 41 placed obliquely below the distribution tank 6 so as to extend substantially horizontally and then incline downward, in other words, so as not to incline upward.

The film 62 is fusion bonded to the opening edge of the defining wall 65 to close the opening, so that a tank internal space 6*a* for storing ink is formed by the defining wall 65 and the film 64. The film 64 has a flexibility such that when the pressure in the tank is changed (becomes negative); it acts as a diaphragm to reduce the tank volume.

A longitudinally extending backing plate 8 is bonded to the inner surface of the film 62. A plurality of restricting pieces 81 are provided at specific intervals on the backing plate 8 to protrude toward the inside of the tank. When the film 62 is depressed toward the inside of the tank, each restricting piece 81 intervenes between the film 62 and the flange 64 and thereby acts to restrain the film 62 against depression beyond a specific depth (see the dot-dash lines in FIG. 11).

Said one side of the flange 64 is provided substantially in the heightwise middle thereof with four compression springs 9 in alignment in the longitudinal direction. Each compression spring 9 abuts on the backing plate 8 to bias the film 62 toward expanding the tank volume.

Procedure of Filling Nozzle Heads with Ink

Now, a procedure of filling each nozzle head 41 with ink will be described with reference to FIG. 13. The ink filling operation is carried out in an initial condition of the recorder A (a condition that the nozzle head 41 is not filled with ink) and, during the time, the ink jet head 11 is positioned at its cleaning position. First, the shut-off valve 19*a* in the air discharge main tube 19 communicated with the distribution tank 6 is opened, while the shut-off valve 13*b* in the ink supply main tube 13*a* is also opened. In this state, the height of the main tank 13 is raised to increase the backing pressure of the tank. Thus, air in the distribution tank 6 is discharged through the head air discharge tube 49*b* and the air discharge main tube 19, and concurrently ink is supplied from the main tank 13 through the ink supply main tube 13*a* and the head ink supply tube 49*a* to the distribution tank 6 (first step P1).

Thereafter, when the distribution tank 6 is fully filled with ink, the shut-off valve 19*a* in the air discharge main tube 19 is turned to the closed position (second step P2).

In this state, the purge unit 5 is raised so that the ink jet head 11 is put into a cleaning position where the caps 52 are brought into contact with the bottoms of the nozzle heads 41 of the ink jet head 11. Then, the suction pump is operated to carry out a general cleaning operation for simultaneously sucking all of the nozzle heads 41. Thus, ink is supplied from the distribution tank 6 through the ink distribution tubes 49*c* into the individual nozzle heads 41, and eventually the nozzle heads 41 are filled with ink (third step P3).

As described so far, in the above ink jet recorder A, a distribution tank 6 is placed partway along an ink supply passage (i.e., an ink supply main tube 13*a*, a head ink supply tube 49*a* and ink distribution tubes 49*c*) which connects individual nozzle heads 41 contained in each line head 4 with the main tank 13. Further, the number of supply tube connections 67 provided in each distribution tank 6 is smaller than the number of nozzle heads 41 arranged in the associated line head 4. Specifically, a total of three supply tube connections 67 are provided one for each of three distribution tanks 6, while 30 nozzle heads 41 are arranged in one line head 4.

Since, therefore, the number of the ink supply main tubes 13*a* and the number of the head ink supply tubes 49*a* are both smaller than the number of the nozzle heads 41, this results in reduced cost due to the reduction in the number of tubes, size reduction of the recorder A due to savings in the layout space for tubes, and enhanced maintainability due to ease of attachment/detachment of the line head 4. Particularly, attachment and detachment of the line head 4 can be further facilitated since the line head 4 and the main box 2 are connected by the couplers 2*a* and 47*a*.

Furthermore, since the filter 75 is contained in each joint 7 forming the distribution tube connection 69 in each distribution tank 6, entry of impurities into the nozzle heads 41 can be prevented thereby suppressing ink ejection failure. Furthermore, since the joints 7 are detachably attached to the distribution tank 6, the filters 75 can be easily replaced by replacing the joints 7. In addition, since the joints 7 are mounted in correspondence with the nozzle heads 41, replacement can be made for only the joint 7 (filter 75) connected to a specific nozzle head 41, which provides reduced running cost. Furthermore, since the joints 7 are mounted at the lower part of each distribution tank 6, the filters 75 are always immersed in ink even if the distribution tank 6 gets less ink. Therefore, the filter 75 is not exposed and can be prevented from evaporating.

Furthermore, since the distribution tank 6 is designed to define its tank internal space 6*a* by the film 62 and change the tank volume according to the change in internal pressure, it can eliminate inconveniences that would otherwise be caused by a configuration in which two or more nozzle heads 41 are connected to one distribution tank 6. More specifically, for a specific cleaning for separately sucking a specific nozzle head 41, a negative pressure might be developed inside of the distribution tank 6 to allow ink to flow from the other nozzle heads 41 back toward the distribution tank 6. In this embodiment, however, since the film 62 acts as a diaphragm as described already, a negative pressure can be prevented from developing inside of the distribution tank 6. As a result, the occurrence of an ink flowback as described above can be prevented.

When the difference in flow resistance between the nozzle heads 41 is large, the following might otherwise occur: during a general cleaning for sucking all of the nozzle heads 41, ink might flow back toward the distribution tank 6 from the nozzle head 41 which has a large flow resistance and from which ink is less likely to be sucked out by purging; or in printing using a specific nozzle head 41, ink might flow from the other nozzle heads 41 back toward the distribution tank 6. In this embodiment, however, since it can be prevented that a negative pressure is developed inside of the distribution tank 6, the above phenomena can be avoided. In addition, the nozzle in each nozzle head 41 is kept filled with ink so that ink ejection failure can be prevented.

Furthermore, since the film 62 is biased toward expanding the tank volume by the compression springs 9, the film 62 can be prevented from remaining depressed toward the inside of the distribution tank and therefore the effect of absorbing internal pressure variations can be prevented from being hampered. As a result, an ink flowback can be prevented with reliability.

Furthermore, since the restricting pieces 81 are provided on the backing plate 8 bonded to the film 62, the film 62 can be restrained against depression inwardly of the tank beyond a specific depth. More specifically, it can be avoided that the film 62 comes into close contact with the flange 64 and it can be prevented that the through hole 63*a* in the flange 64 is closed by the film 62. Note that the restricting pieces may be provided on the flange 64.

In addition, since ribs 63*b* are provided between openings of adjacent through holes 63*a*, the ribs 63*b* block pressure fluctuation waves caused by sucking at a specific nozzle head 41, printing using a specific nozzle head 41 or other operations so that the pressure fluctuation waves can be prevented from being propagated to the other nozzle heads 41. Therefore, good ink ejection from each nozzle head 41 can be achieved. Note that the ribs 63*b* may be dispensed with.

Furthermore, each of the distribution tanks 6 is connected through the air discharge tube connection 68 and the head air discharge tube 49*b* to the air discharge main tube 19 so that air in the distribution tank 6 can be discharged. Therefore, individual nozzle heads 41 can be filled with ink through the ink supply system including the distribution tanks 6 as described above. When air is precipitated in each nozzle head 41 or other portions of the ink supply passage, the air can be collected to the inside of the distribution tank 6 and then discharged outside through the air discharge main tube 19 and the like. During that time, since each ink distribution tube 49*c* connecting the distribution tank 6 and the associated nozzle head 41 is disposed so as not to incline upward, air is not left in the ink distribution tube 49*c* and can be sent into the distribution tank 6 with reliability. Note that, in the above structure, the distribution tube connections 69 are provided so as to face laterally but they are not limited to this. For example, the distribution tube connections 69 may be provided so as to face downward.

Furthermore, since the air discharge tube connection 68 is provided on the top of each distribution tank 6 and the top wall 65*c* is provided with guide faces 65*d*, air in the distribution tank 6 can be collected to the air discharge tube connection 68 and then discharged through it with reliability.

The positions of the connections 67, 68 and 69 in the distribution tank 6 are not limited to the above but can be changed. Furthermore, each of the connections 67, 68 and 69 is also not limited in number to the above but can be changed. For example, the number of supply tube connections 67 provided for the distribution tank 6 may be two or more (but not larger than the number of nozzle heads 41 for the distribution tank 6). Alternatively, the distribution tube connections 69 may not be provided in number so as to correspond to the nozzle heads 41, but may be provided one for two or more of the nozzle heads 41. Still alternatively, the joints 7 (or filters 75) may be provided one for two or more of the nozzle heads 41.

The line head 4 includes three distribution tanks 6 in the above embodiment, but is not limited to this, and may include one, two, or four or more distribution tanks 6.

In the above embodiment, the distribution tank 6 is made variable in volume by defining the tank internal space 6*a* by the film 62. The configuration that the distribution tank 6 is made variable in volume according to internal pressure variations is not limited to the above, but various configurations can be employed for this purpose.

The nozzle head 41 is not limited to one equipped with a piezoelectric actuator, but may be one equipped with a heater element.

The present invention is not limited to the above embodiment but can be implemented in various forms without departing from its spirit and essential characteristics. The above embodiment should therefore be considered in all respects as illustrative only but not restrictive. The scope of the invention is indicated by the claims but not at all restricted to the description. Further, all modifications and changes which come within the range of equivalents of the claims are intended to be embraced within the scope of the invention.

As described so far, since the present invention can simplify the organization of the ink supply system, it is useful for ink jet recorders, particularly for ink jet recorders whose line head is composed of a plurality of nozzle heads.

The invention claimed is:

1. An ink jet recorder comprising:

a line head including a plurality of nozzle heads arranged over the full width of a recording medium and in alignment along the width of the recording medium;

a main tank for storing ink, the main tank being disposed outside of the line head;

an ink supply passage that connects the main tank to each of the nozzle heads to supply the ink in the main tank to each of the nozzle heads; and at least one distribution tank provided in the line head and partway along the ink supply passage, wherein:

the distribution tank includes an upstream connection connected to the ink supply passage toward the main tank and a downstream connection connected to part of the ink supply passage toward the nozzle heads, the total number of said upstream connections for the line head is smaller than the number of the nozzle heads arranged in the line head, the total number of said downstream connections for the line head is equal to or smaller than the number of the nozzle heads arranged in the line head, and each of the downstream connections comprises a connecting member containing a filter, and each of the downstream connections is detachably attached to the distribution tank so as to be integral with the distribution tank.

2. An ink jet recorder comprising:

a line head including a plurality of nozzles heads arranged over the full width of a recording medium and in alignment along the width of the recording medium;

a main tank, placed outside of the line head, for storing ink;

an ink supply passage that connects the main tank to each of the nozzle heads to supply ink in the main tank to each of the nozzle heads; and at least one distribution tank provided in the line head and partway along the ink supply passage, wherein:

the distribution tank includes an upstream connection connected to part of the ink supply passage toward the main tank and a downstream connection connected to part of the ink supply passage toward the nozzle heads, the total number of said upstream connections for the line head is smaller than the number of the nozzle heads arranged in the line head, and the distribution tank has a structure that is variable in volume according to variation in internal pressure.

3. An ink jet recorder comprising:

a lead head including a plurality of nozzle heads arranged over the full width of a recording medium the line head being aligned along the width of the recording medium;

a main tank, placed outside of the line head for storing ink;

an ink supply passage that connects the main tank to each of the nozzle heads to supply the ink in the main tank to each of the nozzle heads; and at least one distribution tank that is provided in the line head and partway along the ink supply passage, wherein:

the distribution tank includes an upstream connection connected to part of the ink supply passage toward the main tank and a downstream connection connected to part of the ink supply passage toward the nozzle heads, the total number of said upstream connections for the line head is smaller than the number of the nozzle heads arranged in the line head, the distribution tank has a structure that is variable in volume in accordance with variation in internal pressure, and the distribution tank includes a flexible wall and defining walls that define a tank internal space together with the flexible wall.

4. An ink jet recorder comprising:

a line head including a plurality of nozzle heads arranged over the full width of a recording medium, the line head being aligned along the width of the recording medium;

a main tank, placed outside of the line head, for storing ink;

an ink supply passage connecting the main tank to each of the nozzle heads in order to supply the ink in the main tank to each of the nozzle heads; and at least one distribution tank that is provided in the line head and partway along the ink supply passage, wherein:

the distribution tank includes an upstream connection connected to part of the ink supply passage toward the main tank and a downstream connection connected to part of the ink supply passage toward the nozzle heads, the total number of said upstream connections for the line head is smaller than the number of the nozzle heads arranged in the line head, the distribution tank has a structure that is variable in volume according to variations in internal pressure, the distribution tank includes a flexible wall and defining walls that define a tank internal space together with the flexible wall, and the distribution tank further includes a biasing member for biasing the flexible wall toward expanding the volume of the tank.

5. An ink jet recorder comprising:

a line head including a plurality of nozzle heads arranged over the full width of a recording medium and in alignment along the width of the recording medium;

a main tank placed outside of the line head for storing ink;

an ink supply passage that connects the main tank to each of the nozzle heads to supply the ink in the main tank to each of the nozzle heads; and at least one distribution tank provided in the line head and partway along the ink supply passage, wherein:

the distribution tank includes an upstream connection connected to part of the ink supply passage toward the main tank and a downstream connection connected to part of the ink supply passage toward the nozzle heads, the total number of said upstream connections for the line head is smaller than the number of the nozzle heads arranged in the line head, the distribution tank has a structure that is variable in volume according to variations in internal pressure, the distribution tank includes a flexible wall and defining walls which define a tank internal space together with the flexible wall, and the distribution tank further includes a restricting piece for intervening between the flexible wall and the defining wall opposed to the flexible wall to restrain the flexible wall against depression inward of the tank beyond a specific depth.

6. An ink jet recorder comprising:

a line head including a plurality of nozzle heads arranged over the full width of a recording medium and in alignment along the width of the recording medium;

a main tank, placed outside of the line head, for storing ink;

an ink supply passage connecting the main tank to each of the nozzle heads to supply the ink in the main tank to each of the nozzle heads; and at least one distribution tank provided in the line head and partway along the ink supply passage, wherein:

the distribution tank includes an upstream connection connected to part of the ink supply passage toward the main tank and a downstream connection connected to part of the ink supple passage toward the nozzle heads, the total number of said upstream connections for the line head is smaller than the number of the nozzle heads arranged in the line head, and the distribution tank further includes a plurality of ribs disposed in the tank internal space between adjacent openings of the downstream connections, respectively.

7. An ink jet recorder comprising:

a line head including a plurality of nozzle heads arranged over the full width of a recording medium and in alignment along the width of the recording medium;

a main tank that is placed outside of the line head and stores ink;

an ink supply passage that connects the main tank to each of the nozzle heads to supply the ink in the main tank to each of the nozzle heads; and at least one distribution tank that is provided in the line head and partway along the ink supply passage, wherein:

the distribution tank includes an upstream connection connected to part of the ink supply passage toward the main tank and a downstream connection connected to part of the ink supply passage toward the nozzle heads, the total number of said upstream connections for the line head is smaller than the number of the nozzle heads arranged in the line head, the distribution tank further includes an air discharge connection connected to an air discharge passage for discharging air existing tank internal space, the air discharge connection is provided on the top of the distribution tank, and the distribution tank further includes guide faces disposed in the tank internal space so as to be inclined upward toward the air discharge connection.

* * * * *